US007568578B2

(12) United States Patent
Berman

(10) Patent No.: US 7,568,578 B2
(45) Date of Patent: Aug. 4, 2009

(54) WHEEL SPINNING TOY VEHICLE IN BLISTER PACKAGE WITH CLUTCH MECHANISM

(76) Inventor: Stephen Berman, 22619 Pacific Coast Hwy., Malibu, CA (US) 90265

( * ) Notice: Subject to any disclaimer, the term of this patent is extended or adjusted under 35 U.S.C. 154(b) by 60 days.

(21) Appl. No.: 11/666,902

(22) PCT Filed: May 27, 2005

(86) PCT No.: PCT/US2005/018761

§ 371 (c)(1),
(2), (4) Date: Oct. 23, 2007

(87) PCT Pub. No.: WO2006/049649

PCT Pub. Date: Nov. 5, 2006

(65) Prior Publication Data

US 2008/0197034 A1 Aug. 21, 2008

Related U.S. Application Data

(60) Provisional application No. 60/624,336, filed on Nov. 1, 2004.

(51) Int. Cl.
*A63H 17/00* (2006.01)
*B65D 73/00* (2006.01)

(52) U.S. Cl. ..... 206/335; 206/471; 206/779; 446/75

(58) Field of Classification Search ..... 206/319, 206/335, 457, 461, 471, 775, 779; 446/75, 446/76, 77, 78, 444, 450
See application file for complete search history.

(56) References Cited

U.S. PATENT DOCUMENTS

| | | | | |
|---|---|---|---|---|
| 4,185,739 | A | 1/1980 | Wilford | |
| 4,574,946 | A | 3/1986 | Hanazato | |
| 4,595,097 | A | 6/1986 | Herstein | |
| 4,905,828 | A * | 3/1990 | Dods | 206/335 |
| 4,959,035 | A * | 9/1990 | Murasaki | 446/40 |
| 5,129,516 | A | 7/1992 | Theros | |
| 5,188,222 | A | 2/1993 | Pierce | |
| D350,693 | S | 9/1994 | Pratt | |
| 5,411,138 | A | 5/1995 | Klawiter | |
| 5,890,594 | A | 4/1999 | Hansen et al. | |
| 5,896,991 | A | 4/1999 | Hippely et al. | |
| D424,428 | S | 5/2000 | Hart | |
| 6,152,298 | A | 11/2000 | Dods | |
| D477,782 | S | 7/2003 | Throgmorton | |
| 2005/0284788 | A1 * | 12/2005 | Elliott et al. | 206/461 |
| 2007/0084693 | A1 * | 4/2007 | Byers | 192/66.1 |
| 2008/0023913 | A1 * | 1/2008 | Barthold et al. | 273/241 |

* cited by examiner

*Primary Examiner*—Jacob K Ackun, Jr.
(74) *Attorney, Agent, or Firm*—Tope-McKay & Associates

(57) ABSTRACT

The invention relates to a wheel spinning toy vehicle in a blister package with a clutch mechanism that keeps the wheel from launching off of the toy vehicle while spinning.

3 Claims, 5 Drawing Sheets

WHEEL SPINNING TOY VEHICLE IN BLISTER PACKAGE WITH CLUTCH MECHANISM

RELATED APPLICATIONS

This is a non-provisional application of a provisional application Ser. No. 60/624,336 filed Nov. 1, 2004

BACKGROUND OF THE INVENTION

Field of the Invention

The present invention relates to a wheel spinning toy vehicle in a blister package. It is understood however that the invention is not limited to a blister package but is also capable of being a toy vehicle in any kind of retail package. In particular, the invention relates to a wheel spinning toy vehicle in a blister package with a clutch mechanism that keeps the wheel from launching off of the toy vehicle while spinning.

The Prior Art

U.S. Design Pat. No. 477,782 discloses a blister package for a small car.

U.S. Pat. No. 5,411,138 discloses a blister package for a toy car vehicle.

U.S. Pat. No. 5,129,516 discloses a tape measure in a blister package.

SUMMARY OF THE INVENTION

The present invention provides for a toy vehicle 5 disposed in a blister package 25. The toy vehicle 5 has a pull cord or a rip cord that is partially located within the blister package 25 and the consumer pulls on the pull cord. The end pull cord has an anti-theft device by means of a pull cord clip and a screw that prevents the pull cord from being totally removed from the blister package. The pull cord has teeth which engage the teeth on the gears inside the housing of the toy vehicle causing one of the wheels of the toot vehicle to spin. A clutch mechanism locks the wheel in place on the toy vehicle but permits the wheel to keep spinning in place when the pull cord is pulled.

DETAILED DESCRIPTION OF THE PREFERRED EMBODIMENTS

Figure 3:
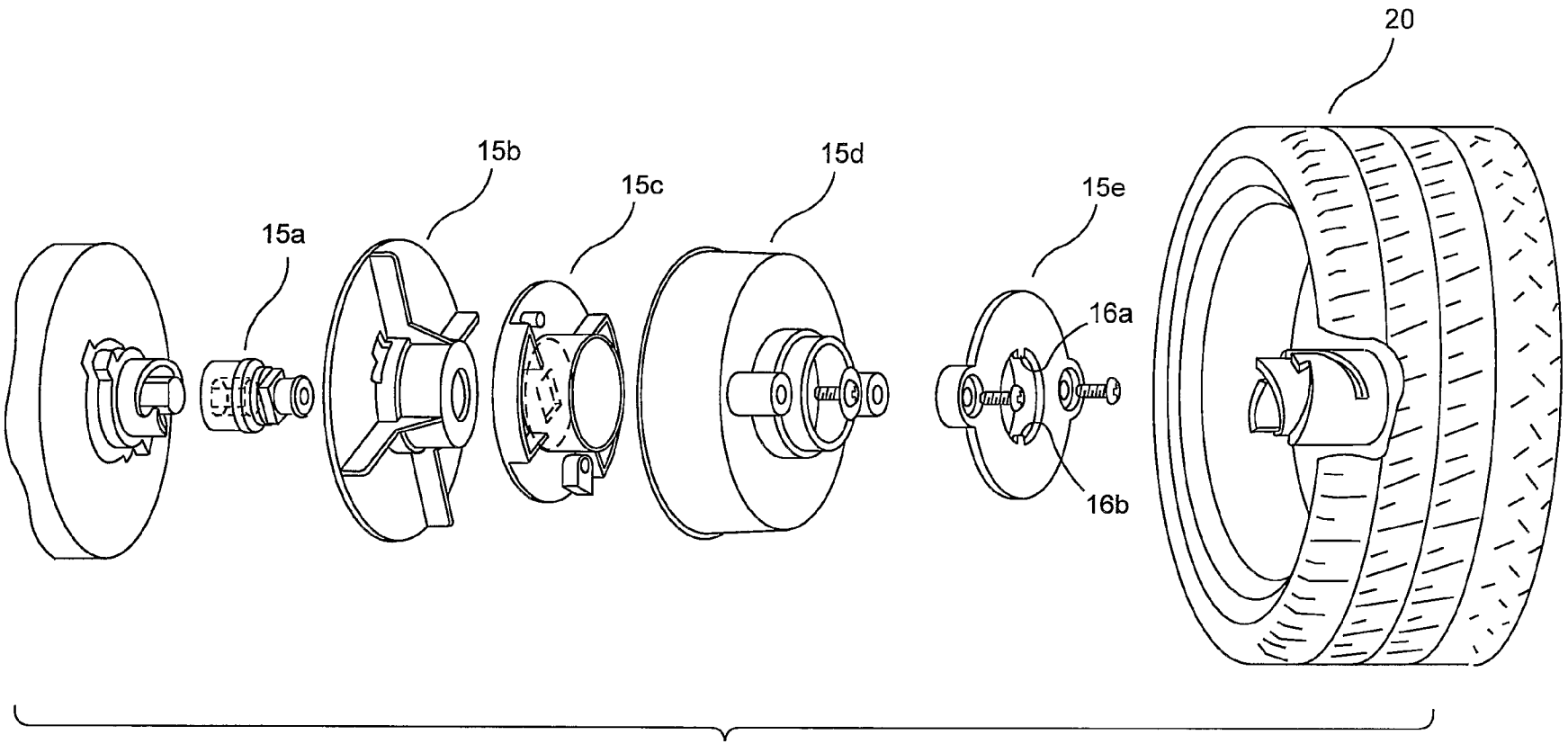
FIG. 3 is a fully exploded view of the clutch mechanism of the invention.
Figure 4:
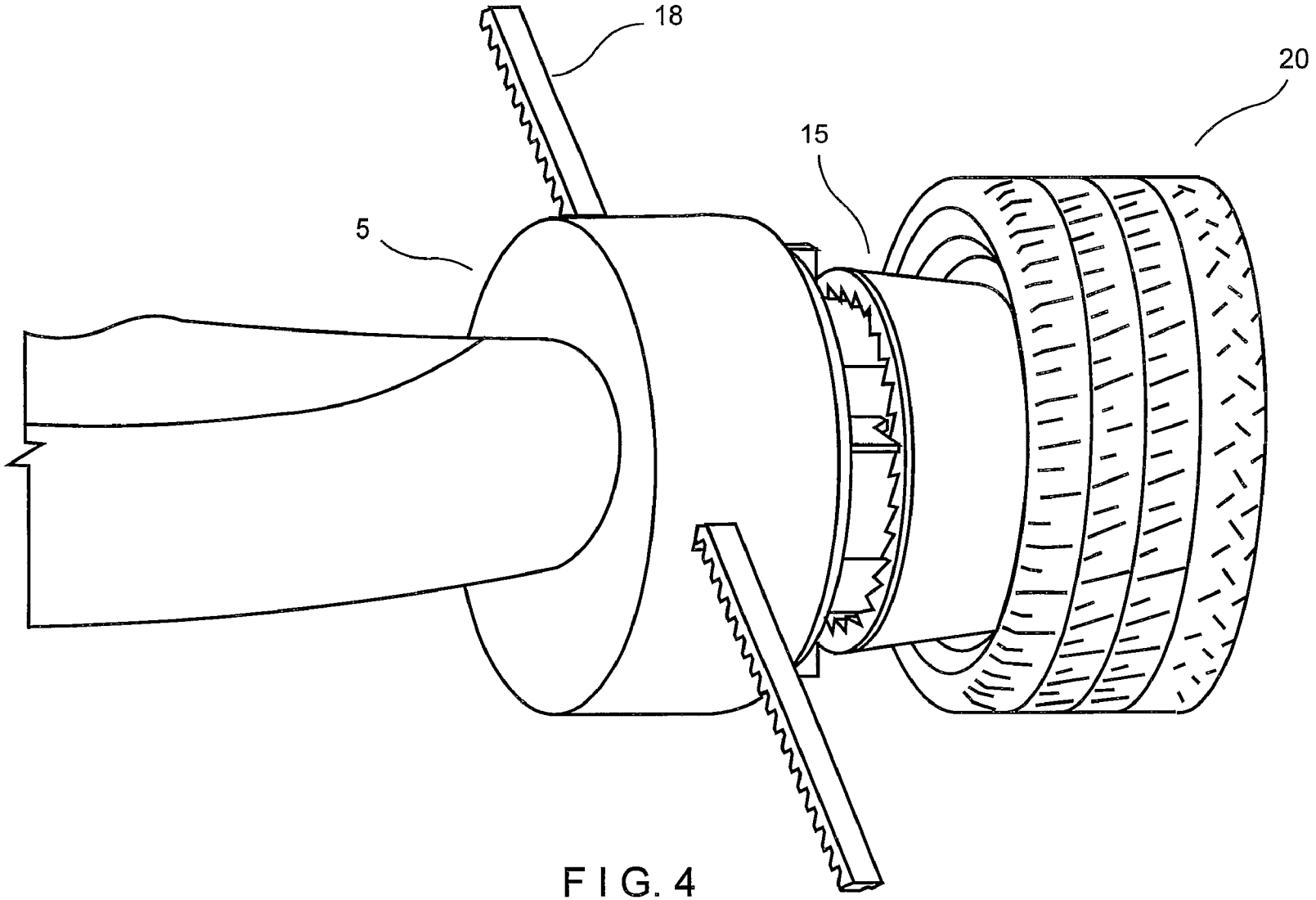
FIG. 4 illustrates the clutch mechanism of the present invention attached to a tire with the pull rod inserted.
Figure 5:
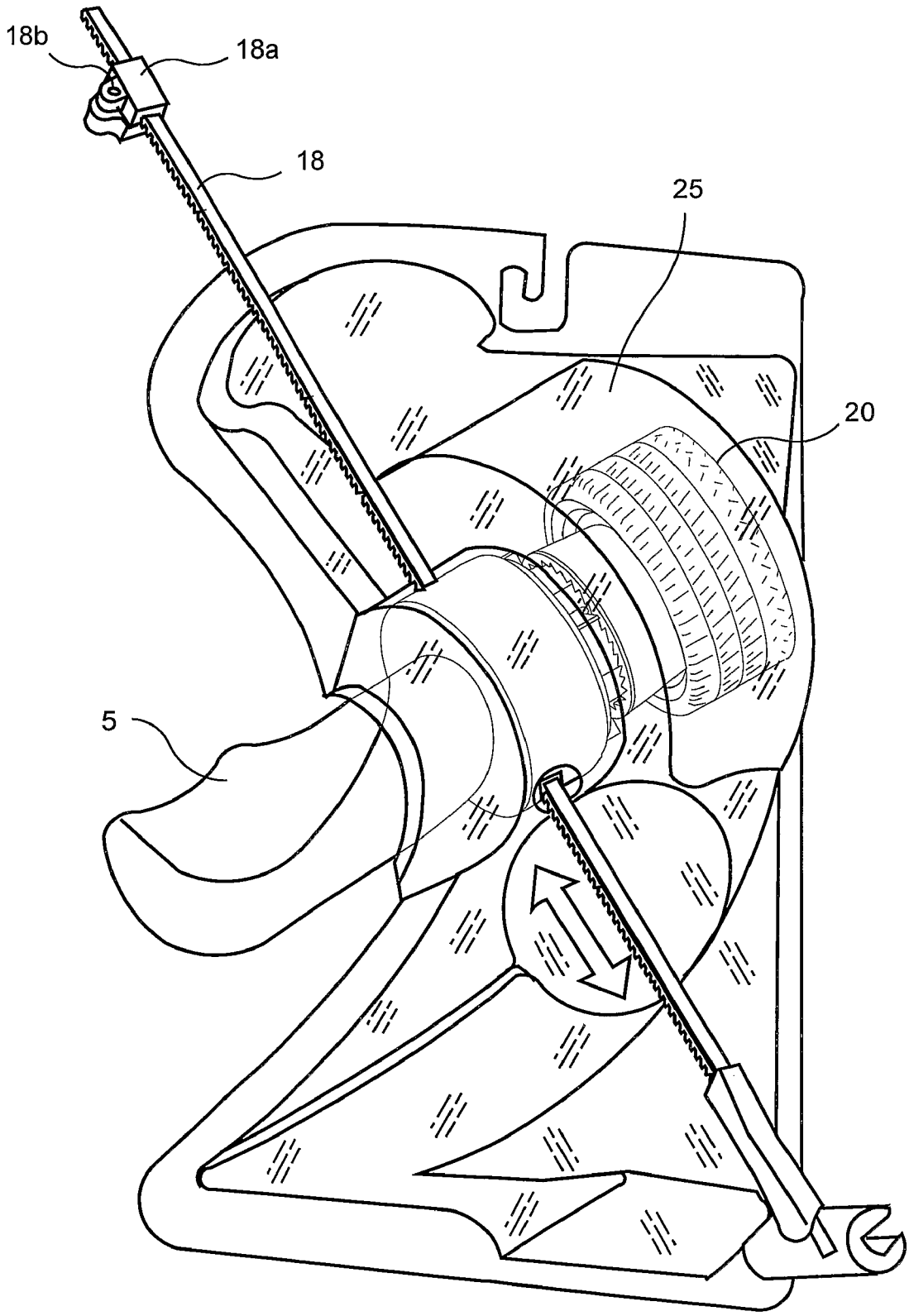
FIG. 5 illustrates the present invention in the blister package with the anti-theft device attached.

Referring now to the drawings, FIGS. 1-5 illustrate the present invention in which toy vehicle with at least one wheel is housed within a blister package preferably on cardstock with an inner support blister, two paper inserts and a Mylar sticker included (see FIG. 5). The toy vehicle has a clutch mechanism 15, a wheel/tire assembly 20, a pull cord or rip cord 18 and a pull cord clip 18*a* and a screw 18*b* where the clip and screw act as an anti-theft device to prevent the pull cord from being completely pulled out of the opening in the blister package 25 through which the pull cord 18 is partially inserted.

Figure 1:
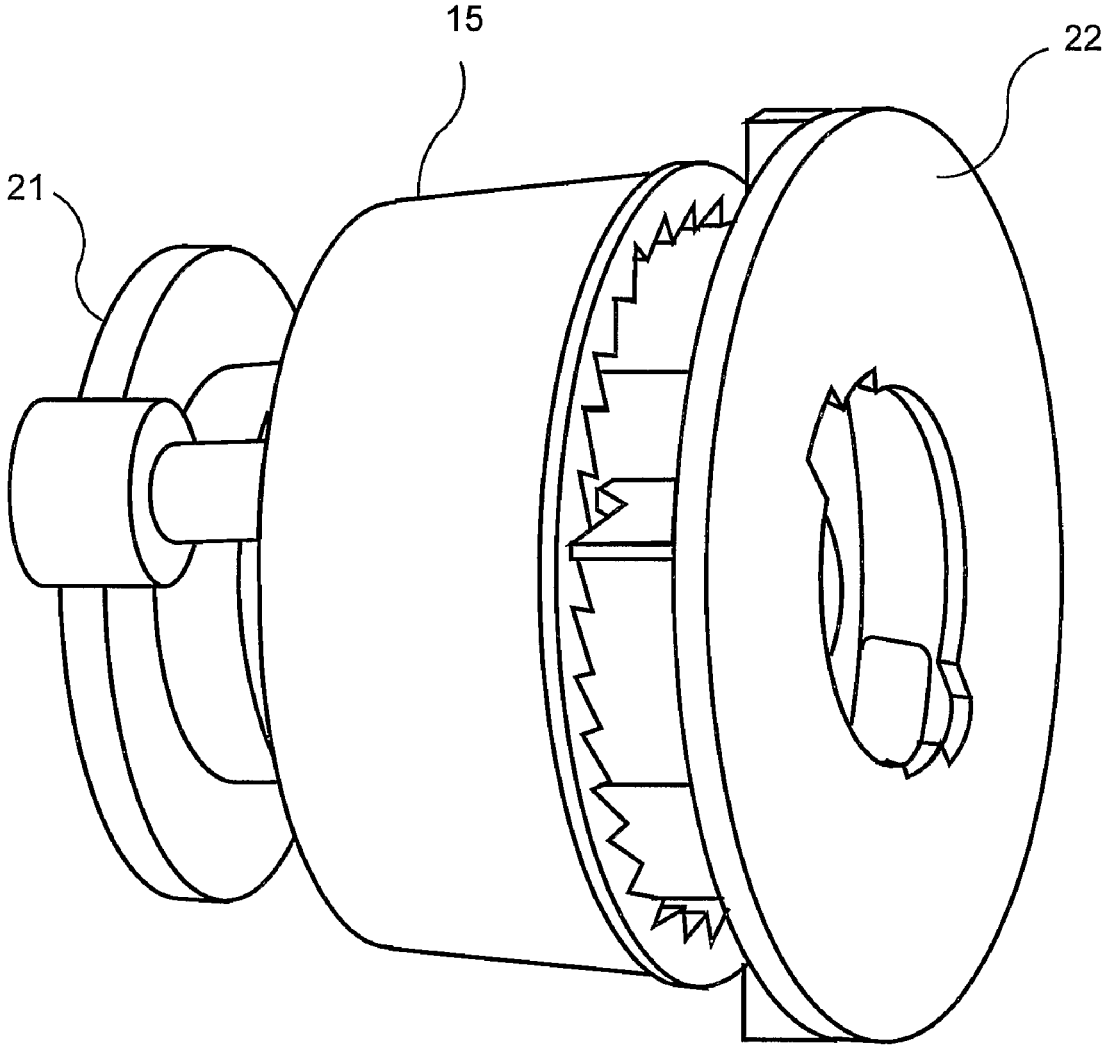
FIG. 1 illustrates a perspective view of the clutch mechanism, fully assembled, of the present invention.

FIG. 1 illustrates a perspective view of the invention showing the clutch mechanism or clutch adaptor adapted to attach to the tire on adaptor side 21 with side 22 adapted to be connected to the launcher.

Figure 2:
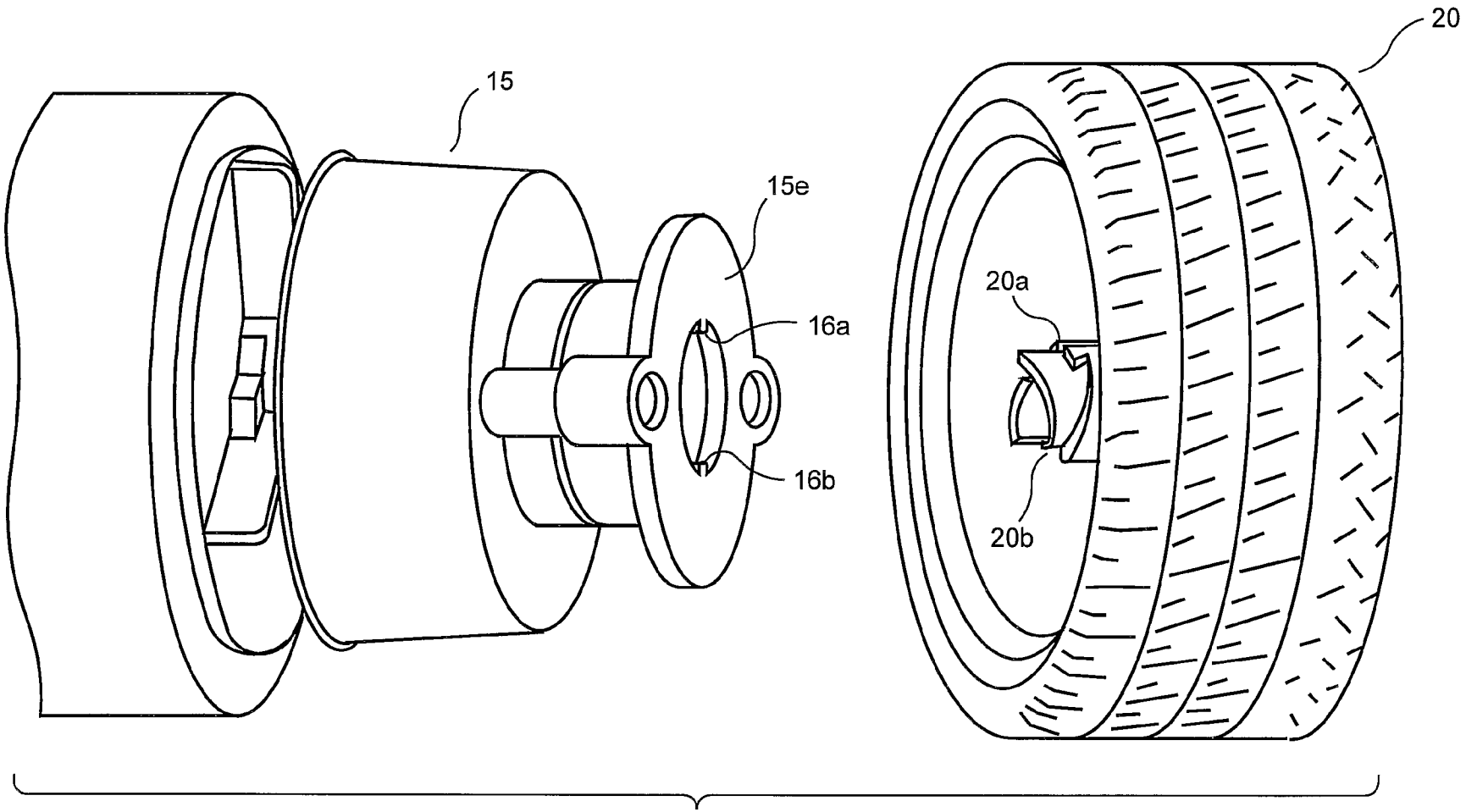
FIG. 2 is a partially exploded view of the clutch mechanism of the present invention.

FIG. 2 illustrates how the clutch adaptor or clutch mechanism 15 attaches to the tire 20 where component 15*e* of the clutch adaptor has two tabs 16*a*, 16*b* that fit into two grooves 20*a*, 20*b* of the tire so that the tire 20 is fastened to the clutch mechanism 15. It can be seen that the clutch mechanism 15 resembles a brake rotor and uses the same locking mechanism as a brake rotor to lock the top clutch to the wheel/tire combination.

FIG. 3 is a fully exploded view of the clutch mechanism of the invention showing the five components 15*a*, 15*b*, 15*c*, 15*d*, 15*e* of the clutch mechanism 15 and how they are connected to each other with component 15*e* being attached by means of two tabs 16*a*, 16*b* to the grooves 20*a*, 20*b* of the tire 20 to attach the clutch mechanism 15 to the tire 20.

FIG. 4 illustrates the clutch mechanism 15 attached to the wheel 20 and the toy vehicle 5 making it one unit ready for use in the blister package 25.

FIG. 5 illustrates the invention in the blister package 25. All the parts of the invention will be nested between the inner blister and the outer blister then heat-sealed onto the cardstock. The handle of the invention will hold the clutch mechanism 15 in place via press fit. The clutch mechanism 15 will hold the wheel/tire assembly 20 via press fit. When a prospective purchaser wishes to use this try me feature he or she will pull the item off the peg it is hanging on. The person will then hold the item with one hand and pull the pull cord 18. While pulling the pull cord 18 the pull cord teeth will engage the teeth on the gears in the housing of the toy vehicle causing a spinning action within the toy vehicle and spinning the wheel/tire combination. The clutch mechanism 15 will permit the wheel/tire combination 20 of the at least one wheel of the vehicle to spin freely after the pull cord 18 has stopped movement but keep the wheel/tire combination from launching off the housing of the toy vehicle 5.

I do not limit myself to any particular details of construction set forth in the Specification and illustrated in the accompanying drawings, as the same refers to and sets forth only certain embodiments of the invention, and it is observed that the same may be modified without departing from the spirit and scope of the claimed invention.

The invention claimed is:

1. A toy vehicle in a blister package, comprising:

a toy vehicle having at least one wheel and a housing having gears therein;

a blister package adapted to house said toy vehicle;

a pull cord having teeth on at least on side surface thereof and being partially disposed within said blister package and adapted to be inserted within an opening of said housing of said toy vehicle wherein said teeth of said pull cord engaging said teeth on said gears of said housing to cause said one wheel to spin when said pull cord is being pulled out of said housing and said blister package by a prospective consumer; and a clutch mechanism located in said housing for maintaining said wheel on said vehicle while said wheel is spinning.

2. The toy vehicle according to claim 1 wherein said clutch mechanism has a component having a pair of tabs that are adapted to fit into grooves of said at least one wheel in order to attach said wheel to said clutch mechanism.

3. The toy vehicle according to claim 1 wherein said pull cords has an anti-theft device formed of a pull cord clip and a screw that prevents said pull cords from being totally removed from said blister package.

* * * * *